US005896110A

United States Patent [19]

Kojima

[11] Patent Number: 5,896,110

[45] Date of Patent: Apr. 20, 1999

[54] VEHICLE ANTENNA ATTACHING APPARATUS SUITABLE FOR ATTACHING A ROD-SHAPED ANTENNA TO A VEHICLE

[75] Inventor: Hiroyoshi Kojima, Kawasaki, Japan

[73] Assignee: Harada Industry Co., Ltd., Tokyo, Japan

[21] Appl. No.: 08/798,377

[22] Filed: Feb. 7, 1997

[30] Foreign Application Priority Data

Feb. 9, 1996 [JP] Japan ..... 8-023949

[51] Int. Cl.[6] ..... H01Q 1/32

[52] U.S. Cl. ..... 343/715; 343/711; 343/712

[58] Field of Search ..... 343/715, 711, 343/712, 900, 878, 880, 882, 888; H01Q 1/32

[56] References Cited

U.S. PATENT DOCUMENTS

| | | | |
|---|---|---|---|
| 2,470,693 | 5/1949 | Finke | 343/715 |
| 2,481,823 | 9/1949 | Cejka | 343/715 |
| 2,899,485 | 8/1959 | Friedberg et al. | 343/715 |
| 2,953,630 | 9/1960 | Cejka | 343/715 |
| 3,003,149 | 10/1961 | Grashow | 343/715 |
| 4,136,986 | 1/1979 | Grashow | 343/715 |
| 4,173,761 | 11/1979 | Liautaud | 343/715 |
| 4,223,314 | 9/1980 | Tyrey | 343/715 |

FOREIGN PATENT DOCUMENTS 0680110 11/1995 European Pat. Off. .

*Primary Examiner*—Hoanganh Le

*Attorney, Agent, or Firm*—John P. White; Cooper & Dunham LLP

[57] ABSTRACT

An apparatus for attaching a rod-shaped antenna to a vehicle comprises supporting plates and a hollow holding member which is formed in a hollow truncated-conical shape, and which includes an opening portion and an elongated-hole formation portion having an elongated hole formed in the upper wall of the hollow holding member. The supporting plates have contact portions and center portions supported to allow supporting plates to rotate at journal support points. The journal support point of each of the supporting plates may be placed within the range of the thickness of the wall when the contact portions of each supporting plate are put into contact with the inner surface of the wall. The elongated-hole formation portion has inner and outer surfaces each of which is arcuated along a circle having a center at the journal support point when the opening portion of the hollow holding member is attached to the wall.

11 Claims, 4 Drawing Sheets

VEHICLE ANTENNA ATTACHING APPARATUS SUITABLE FOR ATTACHING A ROD-SHAPED ANTENNA TO A VEHICLE

BACKGROUND OF THE INVENTION

The present invention relates to a vehicle antenna attaching apparatus suitable for attaching a rod-shaped antenna to, particular, an inclined wall of the vehicle body.

FIGS. 4 and 5 are views showing a conventional apparatus for attaching a rod-shaped antenna to a vehicle. As shown in FIG. 4, an antenna holding hole 32 is formed in a wall 31 of the vehicle body. A rod-shaped antenna holding portion 40 is inserted into the antenna holding hole 32 and fastened to the vehicle by a plurality of fasteners. The antenna holding portion 40 has a power supply (not shown) provided in the center portion of a cylinder 41. A joint pin 42 having a male screw formed in its outer periphery projects from an upper end portion of the cylinder 41. A feeder 43 extends from a lower end portion of the cylinder 41. The joint pin 42 is electrically connected to the feeder 43 through the cylinder 41. A flange 44 doubling as a grounding member is mounted on the center portion of the cylinder 41.

A bottomless dishlike washer 46 used in common as a grounding member is located on the flange 44, and a boat-shaped ground base 47 is placed on the washer 46. Protruding from the upper surface of the ground base 47 are two pairs of projections 47*a* and 47*b*, which are to be put into contact with the inner surface of the wall 31 of the vehicle body. A saw-tooth irregular portion 47*c* is formed on the bottom of the ground base 47. Thus, the ground base 47 is stably located on the washer 46, inclined at a predetermined angle.

A pad 48 is made of soft rubber. An elongated hole 50 is formed in a hollow semispherical insulative holding member 49. The antenna holding portion 40 projects outwardly from the antenna holding hole 32 and is inserted into the elongated hole 50, when the projections 47*a* ard 47*b* of the ground base 47 are put into contact with the inner surface of the wall 31 of the vehicle body. The elongated hole 50 extends in a direction in which the antenna holding portion 40 is inclined, so that the angle can be changed at which the antenna holding portion 40 is inclined to the wall 31 of the vehicle body.

The wall surface of a cover 51 is spherical. A circular hole 51*a* for inserting the joint pin 42 is formed in the center portion of the cover 51. The cover 51 is mounted on the surface of the insulative holding member 49 so as to close the elongated hole 50. Accordingly, even when the mounting angle of the antenna holding portion 40 is changed, the cover 51 closes a part of the elongated hole 50 which remains on the peripheral portion of the joint pin 42. As a result, rain or the like is prevented from entering through the remaining part of the elongated hole 50 in the vehicle. A fixing nut 53 is mounted on the male screw of the joint pin 42 projecting outwardly through the hole 51*a* of the cover 51 and the hole 52*a* of a mounting washer 52. When the fixing nut 53 is screwed down, the washer 52, cover 51, insulative holding member 49 and pad 48 are pressed against the wall 31 of the vehicle body. The antenna holding portion 40 is thereby projected further outwardly from the wall 31. At the same time, the projections 47*a* and 47*b* of the ground base 47 are forced into contact with the inner surface of the wall 31. As a result, the wall 31 is clamped mainly by the ground base 47 and the holding member 49, thereby fixing the antenna holding portion 40 to the wall 31. At this time, the antenna is electrically connected to the wall 31 by the flange 44, washer 46 and ground base 47. The fixing nut 53 sets the proximal end portion of a whip-like rod antenna element (not shown) into engagement with the male screw of the joint pin 42 projecting.

The conventional apparatus described above has the following disadvantages:

First, the cost of the apparatus is high, and the use of the apparatus involves a complicated operation. This is because the apparatus has a large number of structural members.

Second, the prior apparatus may fail to attach the rod antenna element reliably to the vehicle. In other words, when the antenna holding angle of the antenna holding portion 40 is changed, the position at which the upper portion of the dishlike washer 46 is contact with the irregular portion 47*c* of the ground base 47 varies. As a result, that portion of the joint pin 42 which projects upwards through the pad 48, holding member 49, cover 51 and washer 52 also varies in length L. Thus, the length L may be too great or small.

Third, it is difficult for the conventional apparatus to attach the antenna to an inclined wall of the vehicle body, since the hollow holding member 49 is semispherical. In fact, the conventional apparatus cannot attach the antenna to a wall which is inclined at more than 30° to a horizontal plane.

BRIEF SUMMARY OF THE INVENTION

It is an object of the present invention to provide apparatuses of the following types, for attaching a rod-shaped antenna to a vehicle, holding the antenna inclined to a wall of the vehicle at an angle falling within a predetermined range.

It is another object of the present invention to provide an apparatus which can reliably attach a rod-shaped antenna to an inclined steep wall of a vehicle body.

It is another object of the present invention to provide an apparatus wherein there is minimized the longitudinal length of an antenna holding hole formed in an elongated shape in correspondence with the range of the angle at which a rod-shaped antenna can be inclined to a wall of a vehicle body.

It is another object of the present invention to provide an apparatus which the length of the top portion of an antenna holding portion which passes through and projects outwardly from the hollow holding member is kept at a constant value and a rod-shaped antenna can be stably and reliably connected to the antenna holding portion, even when the angle is changed at which the antenna is inclined to a wall of a vehicle body.

It is another object of the present invention to provide an apparatus which can easily attach a rod-shaped antenna a wall of a vehicle body, which can be manufactured at a low parts count and a low cost.

It is another object of the present invention to provide an apparatus which a hollow holding member is not damaged even when a fixing nut is strongly tightened, and which thus can attach a rod-shaped antenna stably and reliably to a wall of a vehicle body.

According to the invention, there is provided an apparatus for attaching a rod-shaped antenna to a vehicle having a wall on which an antenna holding hole is formed, comprising: a rod-shaped antenna holding portion to be inserted into the antenna holding hole, the antenna holding portion having a male screw formed in an outer periphery thereof; a supporting plate unit which has a center portion pivotally and rotatably supported on the antenna holding portion, and a contact portion to be put into contact with an inner surface of the wall of the vehicle body; a hollow holding member which has an opening portion formed to be attached to the wall of the vehicle, and fitted in the antenna holding portion projecting outwardly from the antenna holding hole when the contact portion of the supporting plate unit are put into contact with the wall of the vehicle, the hollow holding member having an upper wall in which an elongated hole is formed, the elongated hole having a length defining a range for an angle at which the rod-shaped antenna is to be inclined to the wall of the vehicle body; a fixing nut which is to be engaged with the male screw formed in the outer periphery of the antenna holding portion projecting outwardly from the wall of the vehicle through the long hole, and which is tightened, thereby to move the hollow holding member toward the outer surface of the wall of the vehicle, to project the antenna holding portion further outwardly from the wall, and to put the contact portions of the supporting plate unit into pressure-contact with the inner surface of the wall, wherein the journal support point of the supporting plate unit is permitted to be placed within a range of a thickness of the wall, when the contact portion of the supporting plate unit is put into pressure-contact with the inner surface of the wall, and the elongated-hole formation portion has inner and outer surfaces each of which is arcuated along a circle having a center at the journal support point when the opening portion of the hollow holding member is attached to the wall of the vehicle.

According to the invention, there is provided an apparatus, wherein the antenna holding portion has a small diameter portion and a large diameter portion which are formed on the distal end side and proximal end side of the antenna holding portion, respectively. The small diameter portion is allowed to be inserted into the elongated hole, and the large diameter portion is not allowed to be inserted into the elongated hole. A step portion is formed between the small diameter portion and the large diameter portion such that the step portion is allowed to be slid over the inner surface of the elongated-hole formation portion when the antenna holding portion is rotated about the intermediate journal support point.

According to the invention, there is provided an apparatus, wherein the hollow holding member comprises: a base portion including an opening portion having an inclined surface matching the angle at which the wall of the vehicle body is inclined; and a holding portion which is detachably connectable to the base portion, and has the elongated hole for allowing the antenna holding portion to be inserted thereinto at a predetermined angle. The base portion and the holding portion are formed independently of each other, and are combined as one body when the base portion and the holding portion are used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DESCRIPTION OF THE INVENTION

Figure 1:
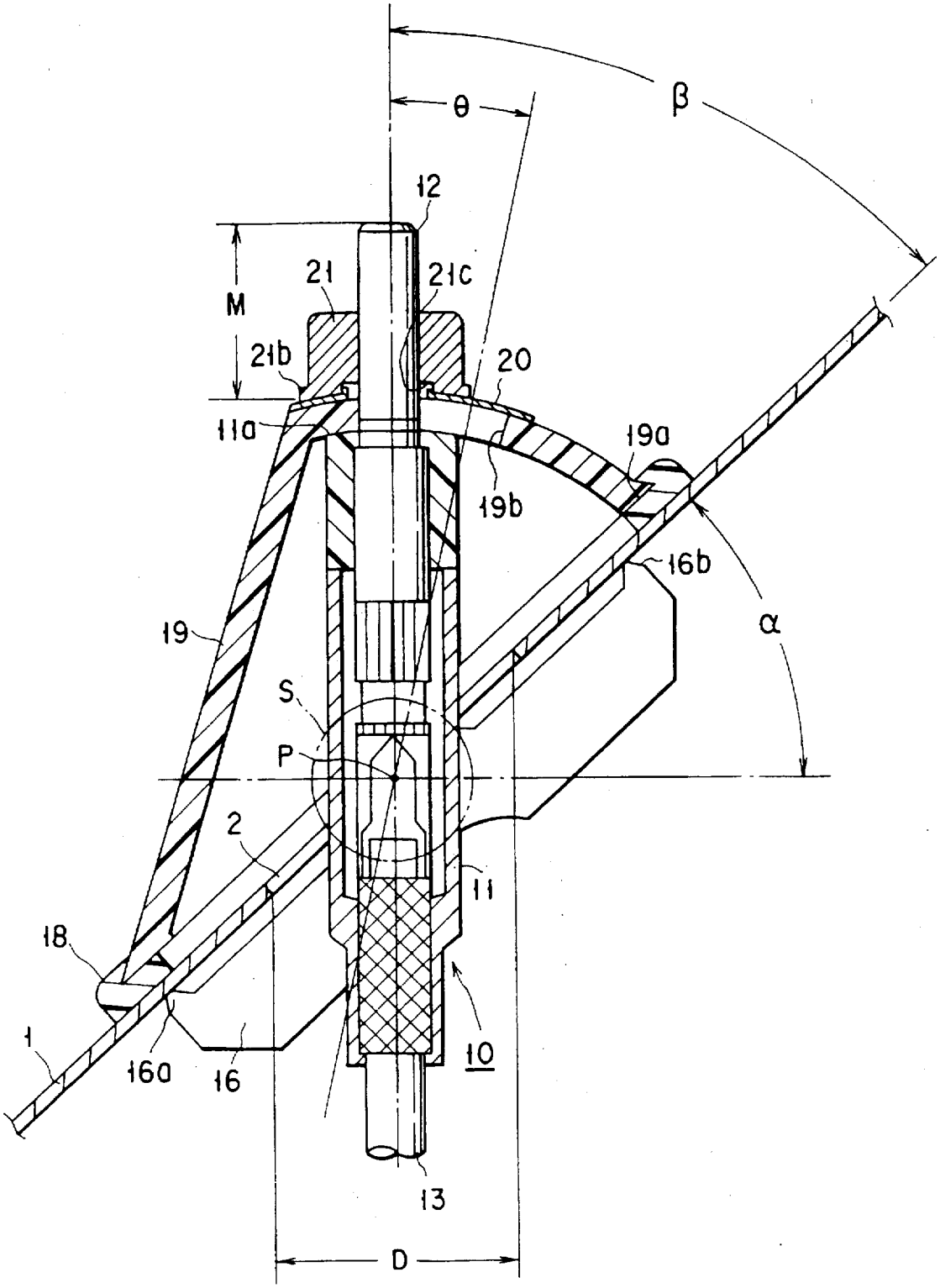
FIG. 1 is a cross-sectional view showing a variable attachment-angle type of apparatus for attaching a rod-shaped antenna to a vehicle, according to the first embodiment of the present invention.
Figure 2:
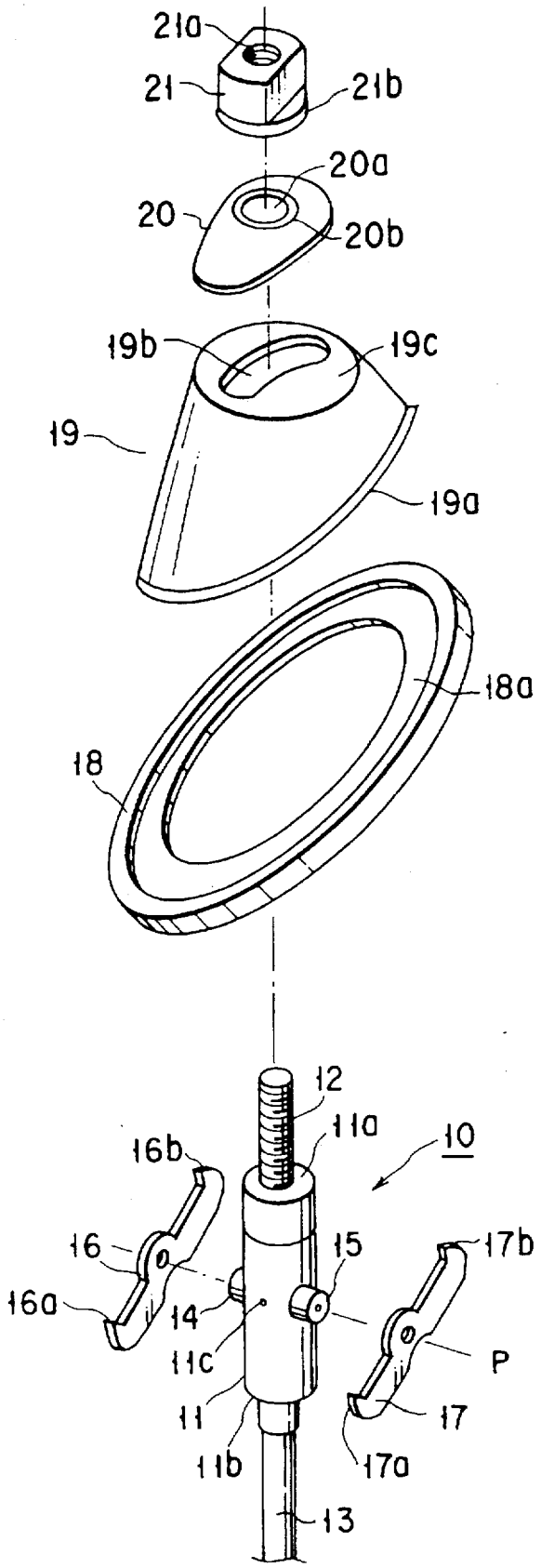
FIG. 2 is an exploded perspective view showing the apparatus according to the first embodiment of the present invention.
Figure 3:
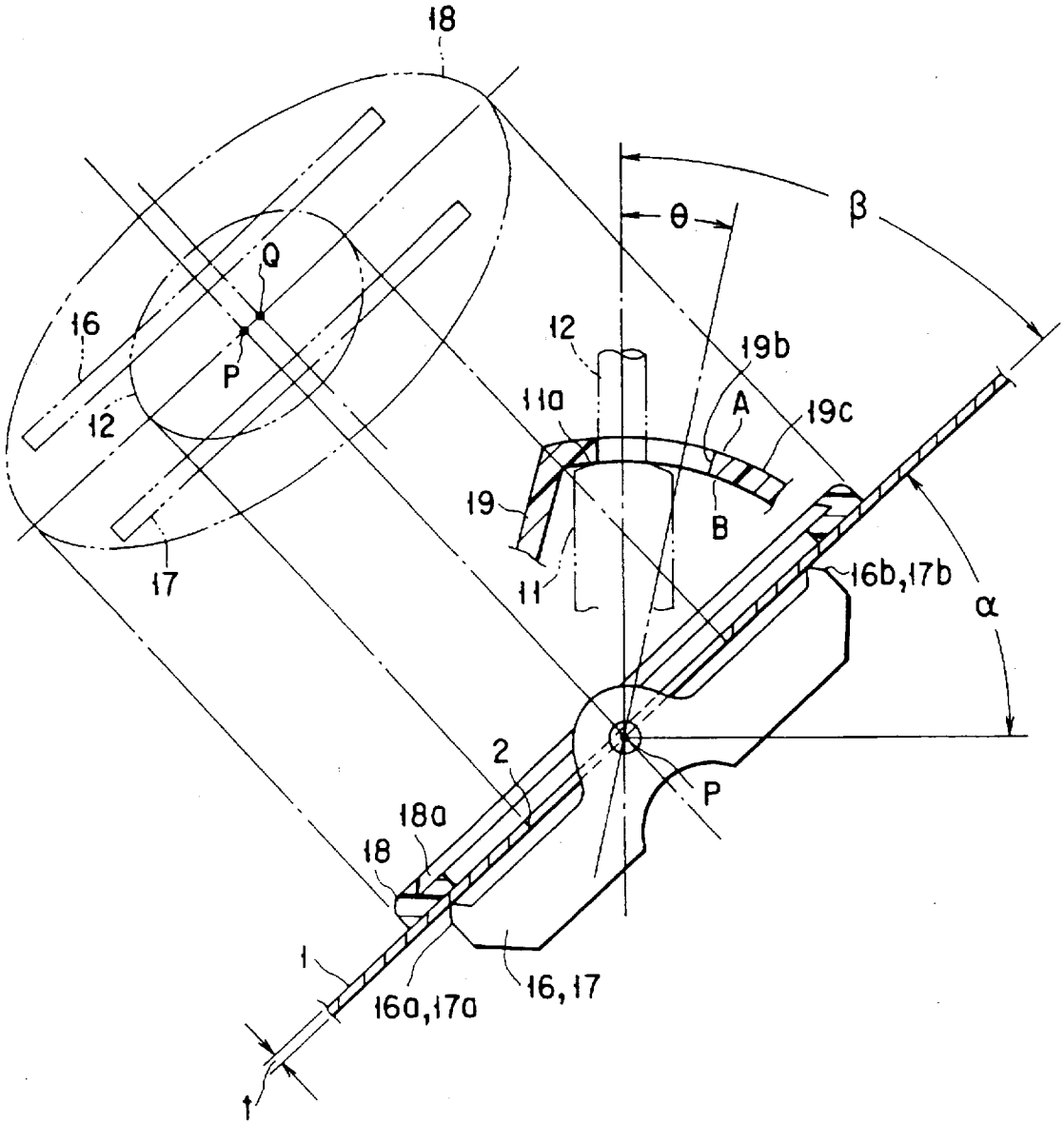
FIG. 3 is a schematic view showing the positional relationships between structural members of the apparatus according to the first embodiment of the present invention.
Figure 4:
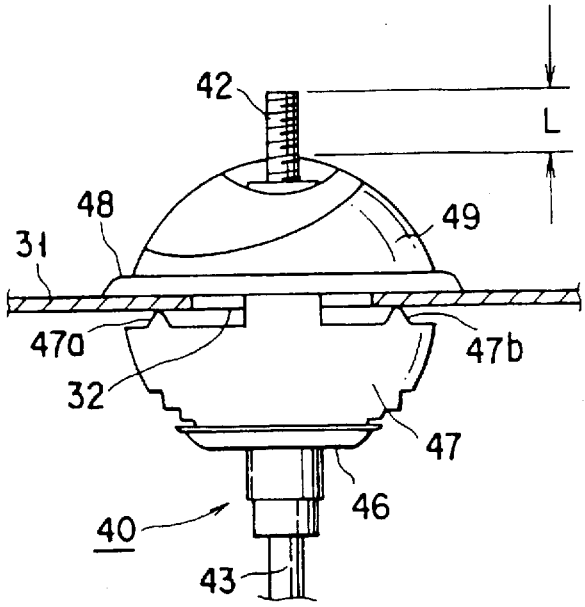
PRIOR ART FIG. 4
FIG. 4 is a side view showing a conventional apparatus for attaching a rod-shaped antenna to a vehicle.
Figure 5:
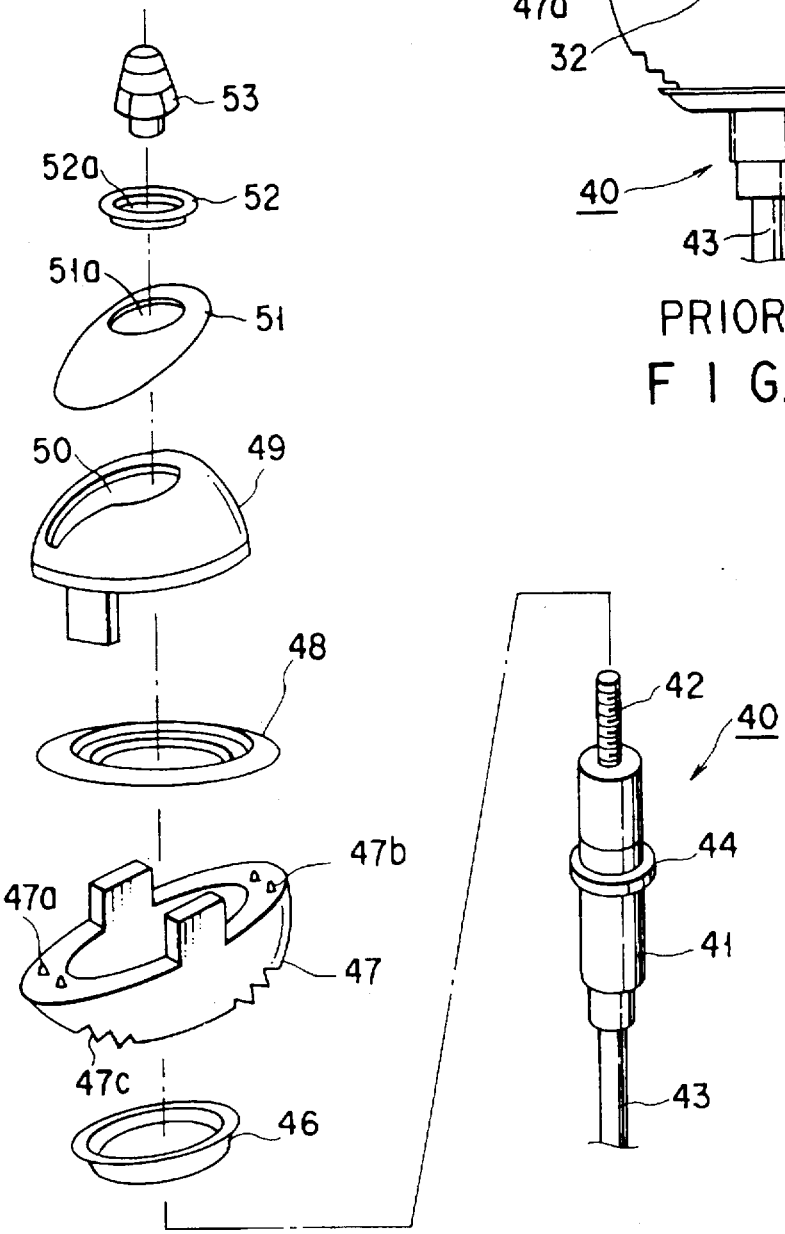
FIG. 5 PRIOR ART
FIG. 5 is an exploded perspective view showing the above conventional apparatus.

FIGS. 1 to 3 are views each showing the structure of a variable attachment-angle type of apparatus for attaching a rod-shaped antenna to a vehicle, according to the first embodiment of the present invention. To be specific, FIG. 1 is a cross-sectional view of the apparatus which has completely attached the antenna to a wall of the vehicle body. FIG. 2 is an exploded perspective view. FIG. 3 is a schematic view showing the positional relationship between structural members. The diagram dictated by two-dot chain lines on the upper left area of FIG. 3 shows the positional relationship between the structural members which is established when the wall of the vehicle body is viewed in a direction perpendicular to the wall. P denotes journal support points of supporting plates described later and an intermediate journal point between the journal support points, and Q denotes the center point of a pad explained later.

Referring to FIGS. 1 and 2, a wall 1 of the vehicle body is inclined at an angle $\alpha$ ranging from about 30° to 70° with reference to a horizontal plane, and an antenna holding hole 2 is formed in the inclined wall 1 of the vehicle body. As shown in FIG. 1, a distance D is the distance between the points at which an imaginary horizontal plane intersects imaginary lines extending vertically from diametrically opposed points of the antenna holding hole 2. The distance D, for example, is about $\phi$19. An antenna holding portion 10 to be engaged with a rod-shaped antenna (not shown) is inserted into the antenna holding hole 2, and attached to the wall 1 by a plurality of fasteners.

The antenna holding portion 10 includes a cylindrical body 11 which is formed as a main body and has a power supply provided at the center portion of the cylindrical body 11. A joint pin 12 projects from an upper end portion 11a of the cylinder body 11. A male screw is formed in the outer peripheral surface of the joint pin 12. A feeder 13 projects from a lower end portion **11*b* of the cylindrical body 11. The joint pin 12 and the feeder 13 are electrically connected to each other through the inside of the antenna holding portion 10. A pair of bearing portions 14 and 15 doubling as grounding members are arranged apart from each other by 180° on a center portion of the outer peripheral portion of the cylindrical body 11, i.e., disposed separately opposite to each other. A supporting plate unit having a pair of elongated supporting plates 16 and 17 also used in common as grounding members are pivotally provided such that the center portions of the supporting plates 16 and 17 are supported on the bearing portions 14 and 15, respectively. The supporting plate 16 has a pair of projections 16*a* and 16*b* which are to be put into contact with the inner surface of the wall 1 and formed at an end portion of the supporting plate 16. Similarly, the supporting plate 17 has a pair of projections 17***a* and 17*b* which are to be put into contact with the inner surface of the wall 1 and formed at an end portion of the supporting plate 17.

A circular pad 18 has a step portion 18*a* constituting an inner circular portion of the circular pad 18, and is formed of an elastic material such as soft rubber. A hollow holding member 19 is formed in a hollow truncated-conical shape, and made of an insulative material such as a hard synthetic resin.

The hollow holding member 19 has an opening portion which is formed in a bottom portion thereof, and which has an inclined surface matching the angle α at which the wall 1 is inclined to the horizontal plane. A flange-shaped edge portion 19*a* is formed at an edge of the opening portion. The edge portion 19*a* is fitted on the step portion 18*a* constituting the inner circular portion of the circular pad 18. As a result, the hollow holding member 19 is engaged with the pad 18.

An elongated hole 19*b* is formed in the upper wall of the hollow holding member 19. The elongated hole 19*b* is a hole for insertion of that portion of the antenna holding portion 10 which is projected outwardly from the antenna holding hole 2 when the projections 16*a* and 16*b* of the supporting plate 16 and the projections 17*a* and 17*b* of the supporting plate 17 are put into contact with the inner surface of the inclined wall 1. The elongated hole 19*b* has a curved longitudinal axis in a direction where the antenna holding portion 10 is inclined. Thus, an attachment angle β can be changed at which the antenna holding portion 10 is inclined to the wall 1 when being attached thereto.

The following are explanations of the position in which the journal support point P of each of the supporting plates 16 and 17 is set, the shape of an elongated-hole formation portion 19*c* of the hollow holding member 19, the movement of the antenna holding portion 10 journalized at the intermediate journal support point P, and the positional relationship between the antenna holding portion 10 and the elongated-hole formation portion 19*c*, etc.

As shown in FIG. 3, the journal support point P of each of the supporting plates 16 and 17 may be displaced in the thickness direction of the inclined wall 1 within the range of the thickness t of the wall 1, when the projections 16*a* and 16*b* and the projections 17*a* and 17*b* are put into pressure-contact with the inclined wall 1 (the journal support point P of each of the supporting plates 16 and 17 and the intermediate journal support point P of this embodiment are located in an imaginary plane extending in parallel from the inner surface of the wall 1). The elongated-hole formation portion 19*c* of the hollow holding member 19 has outer and inner arcuated surfaces A and B each of which is arcuated along a circle the center of which, as shown in FIG. 3, corresponds to the intermediate journal support point P when the opening portion of the hollow holding member 19 is attached to the inclined wall 1. The upper end portion 11*a* of the cylindrical body 11 is formed such that the upper end portion a can be slid over the inner arcuated surface B when the antenna holding portion 10 is rotated about the intermediate journal support point P, i.e., the attachment angle β of the antenna holding portion 10 is changed.

Referring to FIGS. 1 and 2, a cover 20 having a curved surface is intended to close that space or spaces of the elongated hole 19*b* of the hollow holding member 19 in which the joint pin 12 is not located when the antenna holding portion 10 is set. A circular hole 20*a* is formed in the center portion of the cover 20. A burred convex portion 20*b* is formed on the surrounding portion of the circular hole 20*a*. The cover 20 closes the above space or spaces of the elongated hole 19*b* after the antenna holding portion 10 has been attached to the wall 1 at a desired antenna angle β, thereby to prevent rain or the like from entering the elongated hole 19*b*.

A female screw 21*a* is formed in the center portion of a fixing nut 21. One end of the fixing nut 21 has a connection flange 21*b* having a concave portion 21*c* in which the burred convex portion 20*b* of the cover 20 is to be fitted. The fixing nut 21 is engaged with the male screw of the joint pin 12 of the antenna holding portion 10 projecting outwardly from the circular hole 20*a* of the cover 20. When the fixing nut 21 engaged with the male screw of the joint pin 12 is screwed down, fasteners, i.e. the pad 18, the hollow holding member 19 and the cover 20 are pressed against the outer surface of the wall 1, and thus, the antenna holding portion 10 is projected further outwardly from the wall 1 relative to the fixing nut 21. As a result, the projections 16a and 16*b* of the supporting plate 16 and the projections 17*a* and 17*b* of the supporting plate 17 are put into pressure-contact with the inner surface of the wall 1. In such a manner, the wall 1 is clamped by internal fasteners which are the supporting plates 16 and 17, etc. and external fasteners which are the pad 18, the hollow holding member 19, the cover 20 and the fixing nut, etc., whereby the antenna holding portion 10 is fixed to the wall 1. At the same time, an antenna is grounded via the bearing portions 14 and 15 and the supporting plates 16 and 17. A proximal end portion of an antenna element such as a whip-like rod antenna element (not shown) is engaged with the joint pin 12 projecting outwardly from the fixing nut 21.

The apparatus according to the above embodiment may be modified as follows:

First, the apparatus has a supporting plate formed as a single body in place of the pair of supporting plates 16 and 17;

Second, one of the supporting plates 16 and 17 included in the apparatus is formed of a conductive material, and the other is formed of an insulative material;

Third, the apparatus has another grounding means in addition to the supporting plates 16 and 17 used in common as grounding members;

Fourth, the antenna holding portion 10 of the apparatus has a structure which can attach, to the vehicle, an antenna constituted by a plurality of conductive pipes having different diameters and slidably connected to each other; and Fifth, the insulative hollow holding member 19 of the apparatus comprises a base portion and a holding portion which can be detachably connected to the base portion. The base portion has an opening portion having an inclined surface which matches the inclined angle of the wall 31 of the vehicle body. The holding portion has an elongated hole for allowing the antenna holding portion 10 to be inserted thereinto at a desired angle. The base portion and the holding portion are formed independently of each other, and combined as one body when they are used. By virtue of this feature, the apparatus has the following advantage:

Various base portions corresponding to the shapes of the vehicle bodies are prepared, but common parts only may be prepared for the holding portion. In other words, a desired base portion is selected from among the prepared base portions in accordance with the state (shape) of the wall of the vehicle body and the holding portion is assembled by the common parts. The selected base portion is combined with the assembled holding portion, thereby forming the hollow holding member 19. According to this structure, the manufacturing and management of the parts of the apparatus become easy, and the cost thereof is low, as compared with the case where a plurality of types of hollow holding members are prepared each of which comprises a holding portion and a base portion which are assembled as a single unit.

The structure and advantageous effects of the apparatus according to the embodiment are summarized as follows:

The antenna holding hole 2 is formed in the wall 1 of the vehicle body, and the rod-shaped antenna holding portion 10 is inserted into the antenna holding hole 2. The antenna holding portion 10 has a male screw formed in the outer periphery. The supporting plates 16 and 17 have center portions supported on the antenna holding portion 10 to allow the supporting plates 16 and 17 to rotate at the journal support points. The contact portions (16*a*, 16*b*, 17*a*, 17*b*) are put into contact with the inner surface of the wall 1 of the vehicle body. The contact portions are formed at the end portion of each of the supporting plates 16 and 17. The hollow holding member 19 has the opening portion 19*a* formed to be attached to the wall 1 of the vehicle body, and formed in a hollow truncated-conical shape. The hollow holding member 19 is to be mounted on the antenna holding portion 10 projecting outwardly from the antenna holding hole 2 when the contact portions of the supporting plates 16 and 17 are put into with the wall 1 of the vehicle. The elongated hole 19*b* is formed in the upper wall of the hollow holding member 19, and has the length defining the range for the angle β at which the rod-shaped antenna is to be inclined to the wall 1 of he vehicle body. The fixing nut 21 is to be engaged with the male screw formed in the outer periphery of the antenna holding portion 10 projecting outwardly from the wall 1 of the vehicle body through the elongated hole 19*b*, and is to be tightened, thereby to move the hollow holding member 19 toward the outer surface of the wall 1 of the vehicle, to project the joint pin 12 further outwardly from the wall 1, and to put the contact portions of the supporting plates 16 and 17 into pressure-contact with the inner surface of the wall 1. The journal support point of each of the supporting plates 16 and 17 is permitted to be placed within the range of the thickness t of the wall 1, when the contact portions of the supporting plates 16 and 17 are put into pressure-contact with the inner surface of the wall 1. The elongated hole forming region 19*c* on the peripheral wall of the hollow holding member 19 has inner and outer surfaces each of which is arcuated along a circle having a center at an intermediate journal point P when the opening portion of the hollow holding member 19 is attached to the wall 1 of the vehicle body.

In the apparatus, the hollow holding member 19, as stated above, is formed in a hollow truncated-conical shape, and has the opening portion having the inclined surface matching the angle a at which the wall 1 is inclined. Thus, the apparatus can easily and stably attach the antenna to an inclined wall of the vehicle body. For example, even if the wall is inclined to horizontal plane at about 70°, the antenna is easily and stably attached to the wall of the vehicle.

The journal support point P of each of the supporting plates 16 and 17 is set such that it may be placed within the range of the thickness of the wall 1 of the vehicle when the contact portions of the supporting plates 16 and 17 are put into pressure-contact with the inner surface of the wall 1. Thus, the antenna holding hole (elliptic hole) 2 can be formed to have a smallest possible length defining the range θ for the attachment angle β.

Furthermore, the elongated-hole formation portion 19*c*, as repeatedly explained, has the inner and outer surfaces each of which is arcuated along a circle having a center at the intermediate journal support point P when the opening portion is attached to the wall 1 of the vehicle body. Therefore, the length M of that portion of the antenna holding portion 10 which projects outwardly through the elongated hole 19*b* is constant even when the attachment angle β is changed. Consequently, when the fixing nut 21 engaged with the male screw of the antenna holding portion 10 has been completely screwed down, it is necessarily situated in the same position on the male screw. By virtue of the above structural features, the rod antenna element is stably and reliably engaged with the male screw of the antenna holding portion 10.

The conventional apparatus, as explained above, has the dishlike washer 46 and the mounting washer 52. On the other hand, the apparatus of the present invention does not need such members. Thus, in the present invention, the number of structural members of the apparatus is small. The operation (for attaching the antenna to the vehicle) is easily performed, and the cost of the apparatus is low, as compared with the conventional apparatus.

In the apparatus mentioned in the above, the antenna holding portion has the small diameter portion 12 (i.e. the joint pin 12) and the large diameter portion 11 (i.e. the cylindrical body 11) which are formed on the distal end side and proximal end side of the antenna holding portion, respectively. The small diameter portion 12 can be inserted into the elongated hole 19*b*, and the large diameter portion 11 cannot be inserted into the elongated hole 19*b*. The step portion 11*a* (i.e. the upper end portion 11*a*) is formed between the small diameter portion 12 and the large diameter portion 11 such that the step portion 11*a* can be slid over the inner surface of the elongated-hole formation portion 19*c* when the antenna holding portion 10 is rotated about the intermediate journal support point P.

The above apparatus obtains advantageous effects similar to those obtained by the apparatus described in the previous embodiment, and further obtains the following advantageous effect:

When the antenna holding portion 10 has been completely attached to the vehicle, the step portion 11*a* formed at the top of the large diameter portion 11 closely is in close contact with the inner surface of the elongated-hole formation portion 19*c* without providing a gap between the step portion 11*a* and the above inner surface, regardless of the attachment angle of the antenna holding portion 10. Thus, there is no possibility of the hollow holding member 19 being damaged, even when the fixing nut is strongly tightened. By virtue of this feature, the antenna is stably and reliably attached to the vehicle.

In the apparatus mentioned in the previous embodiment, the hollow holding member 19 comprises: the base portion including the opening portion having the inclined surface matching the angle α at which the wall 1 of the vehicle body is inclined; and the holding portion which is detachably connectable to the base portion, and has the elongated hole 19*b* for allowing the antenna holding portion 10 to be inserted thereinto at a desired angle. The base portion and the holding portion are formed independently of each other, and are combined as a single body when they are used.

By virtue of the above feature, the apparatus has the following advantage:

Various base portions corresponding to the bodies of various types of vehicles are prepared but the holding portion can use one common to the various base portions. Therefore, the parts constituting the antenna attaching apparatus can be easily manufactured, and managed, and the cost thereof is low, as compared with the case where a plurality of types of hollow holding members are prepared each of which comprises a holding portion and a base portion which are assembled as a single unit.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An apparatus for attaching a rod-shaped antenna to a vehicle having an inclined wall inclined at a predetermined angle, on which an antenna holding hole is formed comprising:

a rod-shaped antenna holding portion to be inserted into the antenna holding hole, the antenna holding portion having a male screw on an upper end portion thereof;

a supporting plate unit which has a center portion pivotally and rotatably supported on the antenna holding portion, and a contact portion to be put into contact with an inner surface of the inclined wall of the vehicle;

a hollow holding member which has a bottom opening portion having an inclined surface corresponding to the inclined wall of the vehicle, and encloses the antenna holding portion projecting outwardly from the antenna holding hole when the contact portion of the supporting plate unit is put into contact with the inner surface of the wall of the vehicle, the hollow holding member having an upper wall in which an elongated hole for insertion of the upper end portion is formed, the elongated hole having a length defining a range for an angle at which the rod-shaped antenna is to be inclined to the wall of the vehicle;

a fixing nut which is to be engaged with the male screw of the antenna holding portion, which is inserted through the elongated hole, and which is tightened to project the antenna holding portion further outwardly from the wall, and to put the contact portions of the supporting plate unit into pressure-contact with the inner surface of the wall, wherein:

a journal support point to the supporting plate unit is permitted to be placed within a range of a thickness of the wall, when the contact portion of the supporting plate unit is put into pressure-contact with the inner surface of the wall; and the upper wall of the hollow holding member has inner and outer surfaces each of which is arcuated along a circle having a center at the journal support point when the opening portion of the hollow holding member is attached to the wall of the vehicle.

2. The apparatus according to claim 1, wherein the hollow holding member is formed in a hollow truncated-conical shape.

3. The apparatus according to claim 1, wherein the supporting plate unit comprises a pair of supporting plates pivotally and rotatably supported on the antenna holding portion.

4. The apparatus according to claim 3, wherein the supporting plates are shared with grounding members.

5. The apparatus according to claim 3, wherein the supporting plates each have a pair of projections formed at an end portion thereof, which are to be put into contact with the inner surface of the wall of the vehicle.

6. The apparatus according to claim 1, wherein the hollow holding member is formed in a hollow truncated-conical shape, and made of an insulative material.

7. The apparatus according to claim 6, wherein the hollow holding member is made of a hard synthetic resin.

8. The apparatus according to claim 1, wherein:

the antenna holding portion has a small diameter portion and a large diameter portion which are formed on a distal end side of the antenna holding portion and a proximal end side thereof, respectively;

the small diameter portion is allowed to be inserted into the elongated hole, and the large diameter portion is not allowed to be inserted into the elongated hole; and a step portion is formed between the small diameter portion and the large diameter portion such that the step portion is allowed to be slid over the inner surface of the elongated-hole formation portion when the antenna holding portion is rotated about the journal support point.

9. The apparatus according to claim 1, wherein the hollow holding member comprises a base portion including the opening portion, and a holding portion which is detachably connectable to the base portion and has the elongated hole, the base portion and the holding portion are formed independently of each other, and are assembled as a single unit when the base portion and the holding portion are used.

10. The apparatus according to claim 9, wherein the hollow holding member is formed in a hollow truncated-conical shape, and made of an insulative material.

11. The apparatus according to claim 1, wherein the hollow holding member is a single hollow holding member formed to a base hollow portion having the bottom opening portion and the upper wall integrally provided on the base hollow portion.

* * * * *